US011697960B2

(12) United States Patent
Soderqvist

(10) Patent No.: US 11,697,960 B2
(45) Date of Patent: Jul. 11, 2023

(54) PARALLEL OPERATION OF DOOR OPERATORS

(71) Applicant: Assa Abloy Entrance Systems AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 152 days.

(21) Appl. No.: 17/259,880

(22) PCT Filed: Aug. 8, 2019

(86) PCT No.: PCT/EP2019/071280
§ 371 (c)(1),
(2) Date: Jan. 12, 2021

(87) PCT Pub. No.: WO2020/030724
PCT Pub. Date: Feb. 13, 2020

(65) Prior Publication Data

US 2021/0222477 A1 Jul. 22, 2021

(30) Foreign Application Priority Data

Aug. 9, 2018 (SE) ..... 1830236-4

(51) Int. Cl.
*E05F 15/00* (2015.01)
*E05F 15/63* (2015.01)

(52) U.S. Cl.
CPC ..... *E05F 15/63* (2015.01); *E05F 2015/631* (2015.01); *E05Y 2201/434* (2013.01);
(Continued)

(58) Field of Classification Search
CPC ... E05F 15/63; E05F 2015/631; E05F 15/616; E05F 1/105; E05F 1/10; E05Y 2015/631;
(Continued)

(56) References Cited

U.S. PATENT DOCUMENTS 4,365,442 A 12/1982 Speer
4,660,324 A 4/1987 Nyenbrink
(Continued)

FOREIGN PATENT DOCUMENTS

DE 3935173 4/1991
DE 9414049 11/1994
WO 2005021914 3/2005

OTHER PUBLICATIONS

International Search Report and Written Opinion in PCT/EP2019/071280 dated Nov. 7, 2019.
(Continued)

*Primary Examiner* — Chi Q Nguyen
(74) *Attorney, Agent, or Firm* — Wissing Miller LLP

(57) ABSTRACT

A swing door operator system is described, the system including a first swing door operator, a second swing door operator, and at least one door leaf hinged connected at an opening in the wall. The first swing door operator is connected to a first side of the door leaf, the second swing door operator is connected to a second side of the door leaf, the first side of the door leaf is opposite to the second side of the door leaf, and the first swing door operator and the second swing door operator interact to move the door leaf between an open and closed position.

16 Claims, 2 Drawing Sheets

(52) U.S. Cl.
CPC ..... *E05Y 2201/624* (2013.01); *E05Y 2400/36* (2013.01); *E05Y 2400/40* (2013.01); *E05Y 2900/132* (2013.01)

(58) Field of Classification Search
CPC ..... E05Y 2400/33; E05Y 2900/45; E05Y 2900/132; E05Y 2800/113; E05Y 2201/434; E05Y 2201/624; E05Y 2400/36; E05Y 2400/40
USPC ..... 49/13, 506, 70, 139, 140, 39, 340, 345; 340/5.7, 5.71
See application file for complete search history.

(56) References Cited

U.S. PATENT DOCUMENTS 5,392,562 A 2/1995 Carambula
5,515,649 A * 5/1996 Strab ..... E05F 15/53 49/300
5,581,942 A * 12/1996 Sill ..... E05D 7/12 49/153
5,592,780 A * 1/1997 Checkovich ..... E05F 3/222 49/386
5,638,639 A * 6/1997 Goodman ..... E05C 19/001 49/7
5,687,507 A 11/1997 Beran
7,040,675 B1 * 5/2006 Ott ..... E05B 47/023 292/DIG. 43
8,225,458 B1 * 7/2012 Hoffberg ..... E05F 15/73 16/84
8,359,790 B2 * 1/2013 Shin ..... E05F 15/63 49/31
8,677,689 B1 * 3/2014 Draper ..... E05F 15/63 49/281
9,718,334 B2 * 8/2017 Means ..... B60J 7/1642
9,995,076 B1 * 6/2018 Hoffberg ..... E05F 15/42
10,432,132 B2 * 10/2019 Reilly ..... F24S 25/632
10,472,873 B2 * 11/2019 Ladha ..... E05F 3/102
10,731,396 B2 * 8/2020 Attee ..... E05F 11/08
10,808,445 B2 * 10/2020 Hucker ..... E05F 5/027
10,837,212 B2 * 11/2020 Hucker ..... E05F 15/63
11,541,965 B2 * 1/2023 Armstrong ..... B63B 19/12
2003/0005639 A1 * 1/2003 Kowalczyk ..... E05F 15/603 49/340
2005/0091928 A1 5/2005 Okulov et al.
2008/0115543 A1 5/2008 Lanigan et al.
2014/0020298 A1 * 1/2014 Kowalczyk ..... E05D 15/54 49/366
2014/0325911 A1 * 11/2014 Hass ..... E05F 3/224 49/31
2015/0059249 A1 * 3/2015 Yulkowski ..... E05F 15/50 49/31
2015/0101251 A1 * 4/2015 Cui ..... E05F 15/611 49/138
2015/0292250 A1 * 10/2015 Betker ..... E06B 1/522 49/197
2016/0083982 A1 * 3/2016 Yamaguchi ..... E05C 7/045 49/281
2016/0123064 A1 * 5/2016 Wagner ..... H02K 11/33 310/68 D
2018/0163453 A1 * 6/2018 Attee ..... E05F 11/08
2021/0262257 A1 * 8/2021 Stranger ..... E05C 3/008

OTHER PUBLICATIONS

Swedish Search Report in Swedish Pat. Appl. No. 1830236-4, dated Mar. 8, 2019.

* cited by examiner

PARALLEL OPERATION OF DOOR OPERATORS

This application is a 371 of PCT/EP2019/071280 filed on Aug. 8, 2019, published on Feb. 13, 2020 under publication number WO 2020/030724, which claims priority benefits from Swedish Patent Application No. 1830236-4, filed on Aug. 9, 2018, the disclosure of which is incorporated herein by reference.

BACKGROUND OF THE INVENTION

If a heavy or large swing door is to be operated by a swing door operator the momentum from a standard/off the shelf swing door operator is often not large enough for operating the swing door in a suitable way. In these cases special door operators need to be manufactured and installed, which lead to expensive swing door operators and long manufacturing periods since the swing door operator needs to be custom made for each door.

SUMMARY OF THE INVENTION

It is an object of the present invention to mitigate the above problems, and to provide a solution that allows that standard swing door operators to also be used to operate heavier and larger swing doors. According to a first aspect of the present invention, these objects are achieved by a swing door operator system comprising at least a first swing door operator, a second swing door operator, a wall, and at least one door leaf, wherein the at least one door leaf is hinged connected at an opening in the wall, the first swing door operator is connected to a first side of the door leaf, the second swing door operator is connected to a second side of the door leaf, the first side of the door leaf is opposite to the second side of the door leaf, and the first swing door operator and the second swing door operator are configured to interact to move the door leaf between an open and closed position.

Such a solution allows a door leaf to be moved by two swing door operators that cooperate instead of one bigger/stronger swing door operator. This opens up for that smaller and standard swing door operators also can be used for larger or more heavier door leafs. Further, this solution does not require any significant rebuilding or redesigning of a swing door operator to be able to move a heavy or large door.

According to an aspect at least one of the first and the second swing door operator comprise a control unit connected to the other of the first or second swing door operator and wherein the control unit is configured to regulate the operation of the first and the second swing door operator.

According to an aspect the first and the second swing door operator comprise a drive unit comprising at least one motor and at least one spring, wherein the motor and the spring is arranged to interact to move the door leaf.

According to an aspect the control unit is connected to the drive unit and arranged to control the operation of the drive unit.

According to an aspect the first swing door operator is a pull swing door operator and the second swing door operator is a push swing door operator.

According to an aspect the pull swing door operator is configured to pull the door leaf when moving it towards the open position and to push the door leaf when moving it towards the closed position.

According to an aspect the push swing door operator is configured to push the door leaf when moving it towards the open position and to pull the door leaf when moving it towards the closed position.

According to an aspect the control unit is configured to regulate the first and second swing door operators to move the door leaf with a predefined speed pattern from its closed position to its open position and from its open position to its closed position by regulating the force exerted from the first swing door operator and the second swing door operator to exert a combined force according to a predefined force pattern.

According to an aspect the predefined force pattern comprise information regarding the amount of force between 0-100% of its capacity exerted from the first swing door operator at different positions of the door leaf and information regarding the amount of force between 0-100% of its capacity exerted from the second swing door operator at different positions of the door leaf.

According to an aspect the first and/or the second swing door operators comprise an axle and an arm system, the axle is connected to the drive unit and to the arm system and the arm system is further connected to the first or second side of the door leaf, wherein the axle and the arm system is arranged to interact with the drive unit to move said the door leaf.

According to an aspect the arm system of the first swing door operator is a pull arm system arranged to pull the door leaf from its closed position to its open position.

According to an aspect the arm system of the second swing door operator is a push arm system arranged to push the door leaf from its closed position to its open position.

According to an aspect the swing door operator system comprising a door frame mounted in the opening in the wall and comprising two vertical elements and a horizontal element connecting the two vertical elements and the door leaf is hinged connected to one of the vertical elements.

According to an aspect the first swing door operator is mounted at a first side of the wall, the second swing door operator is mounted at a second side of the wall, and the first side of the wall is opposite to the second side of the wall.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant, "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein. Different aspects and examples of the invention can be combined with one or more of the other aspects of the invention.

The present invention relates to door operator systems for different types of doors, door sets and door leafs. More specifically, the invention relates to a swing door operator system for any type of door leafs.

Figure 1:
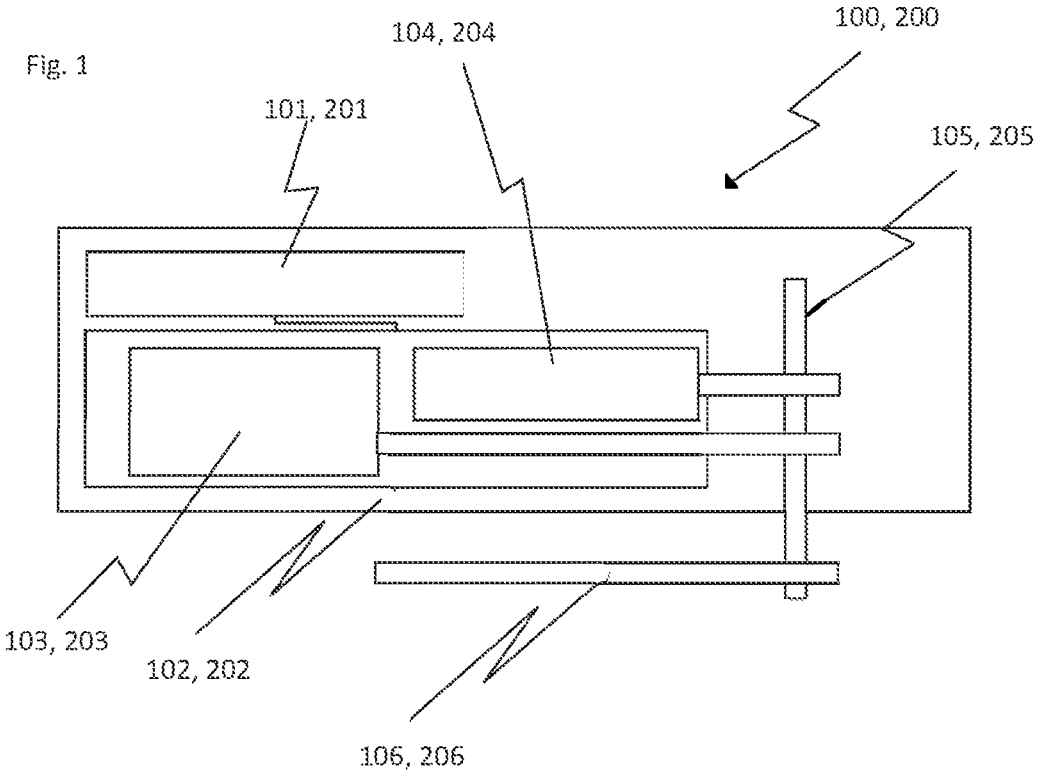
FIG. 1 shows a schematic cross sectional view of a swing door operator according to an aspect of the present invention.
Figure 2:
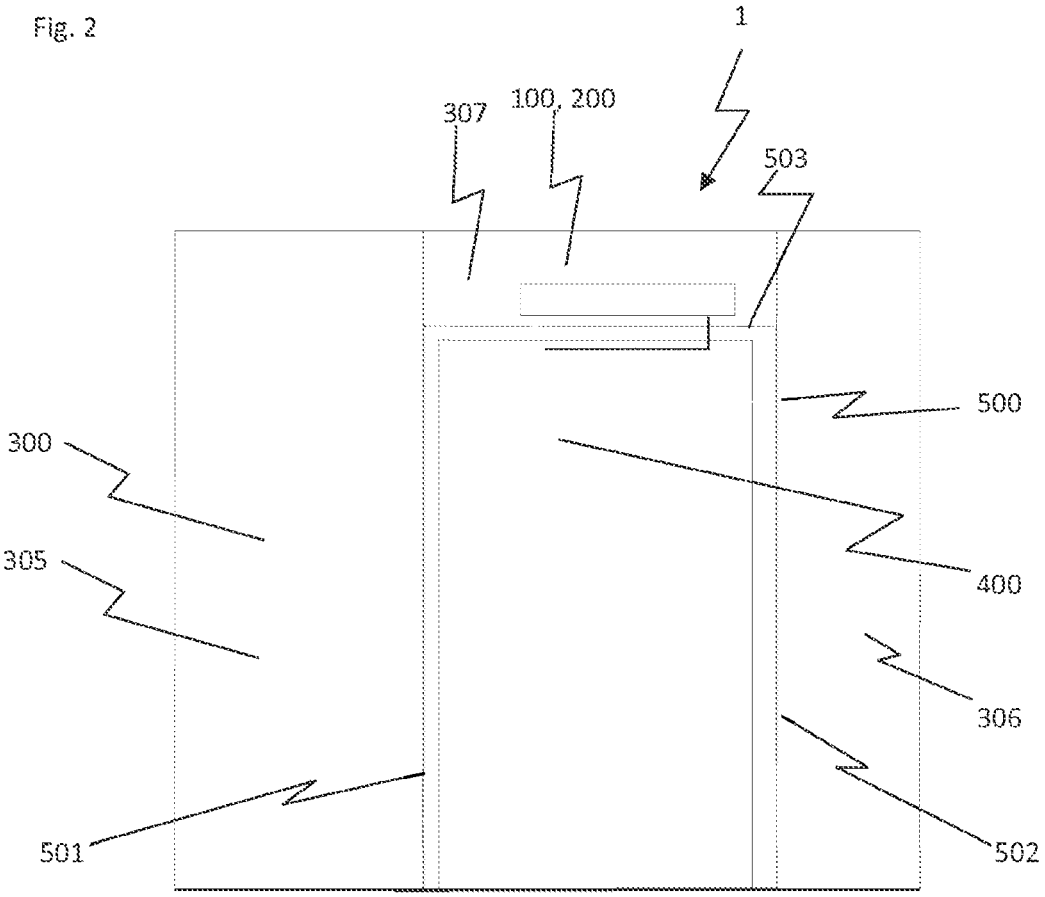
FIG. 2 shows a schematic view of a swing door operator system from a first side of the wall according to an aspect of the present invention.

In FIG. 1 a swing door operator 100, 200 and in FIGS. 2 and 3 a swing door operator system 1 is disclosed according to an aspect of the invention. The swing door operator system 1 comprises according to an aspect a first swing door operator 100, a second swing door operator 200, a wall 300, a door leaf 400 and a doorframe 500. A swing door operator system 1 often is located in buildings to be a part of a system to assist in opening and closing door leafs 400. In some cases, it is a part of a system to restrict the effect of a fire in an emergency by closing a door to restrict the fire or to open a door to ease exit. The system should work in an emergency even if there is a power outage and the system should be able to either close a door leaf 400 to close a fire cell or to open a door leaf 400 to keep an escape route open.

A swing door operator system 1 generally refers to a system having one or two door leafs 400, i.e. a single leaf swing door operator system 1, as disclosed in FIGS. 2 and 3 or a double leaf swing door operator system 1, not disclosed, where each door leaf is hinged or pivoted to the door frame 400 via a hinge 600 at one of its edges. Each door leaf 400 has a main opening/closing edge, arranged opposite to the hinge/pivot edge. In other words, the main opening/closing edge refers to the edge of a door leaf 400 whose distance from a parallel, opposing edge or surface determines the usable opening of the door leafs 400. The opposing opening/closing edge refers to either an edge formed by the main opening/closing edge of a counter closing door leaf, or a fixed edge or a surface towards which the door leaf 400 is moving, such as the doorframe 300.

When the swing door operator system 1 is provided with only one door leaf 400, the door leaf 400 is hinged or pivoted at one edge to the an opening 304 in the wall 300 or in a door frame 500, while the main opening/closing edge of the door leaf 400 closes against, and preferably locks with, the corresponding edge of the door frame 500.

When the swing door operator system 1 is provided with two door leafs 400, the swing door operator system 1 may comprise two door leafs 400, arranged side by side with their respective opening/closing edges in close proximity to each other when both door leafs 400 are in the closed position.

In addition, the swing door operator system 1 may comprise a master door leaf 400, provided with a flange extending along its main opening/closing edge, and a slave door leaf 400. The flange of the master door leaf 400 is adapted to protrude over the main opening/closing edge of the slave door leaf 400, when both door leafs 400 are in the closed position. With such an arrangement, the door leafs 400 can be pushed open in one direction only, preferably from the inside of a room or building in a direction outwards towards the exterior, a corridor, or an evacuation route. The main opening/closing edge of the master door leaf 400 closes against, and preferably locks into, an opposing opening/closing edge, i.e. the main opening/closing edge, of the slave door leaf 400.

The swing door operator 100, 200 of the swing door operator system 1, as disclosed in FIG. 1, comprises a control unit 101, 201, a drive unit 102, 202, an axle 105, 205 and an arm system 106, 206. The swing door operator 100, 200 according to an aspect comprise further components, such as a battery (not disclosed) and different sensors (not disclosed). These components as such are known in the art and will not be described in detail herein.

The drive unit 102, 202 is connected to the control unit 101, 201. The drive unit 102, 202 comprise a spring 104, 204 and a motor 103, 203. The drive unit 102, 202 could further comprise a gearbox (not disclosed). The drive unit 102, 202 is adapted to be connected to the door leaf 400 via the axle 105, 205 and the arm system 106, 206 and to move the door leaf 400 between an open and closed position, i.e. from an open position to a closed position and from a closed position to an open position. The motor 103, 203 and the spring 104, 204 are connected to the axle 105, 205. The motor 103, 203 and the spring 104, 204 are arranged to interact to rotate the axle 105, 205. The spring 104, 204 is according to an aspect a torsion spring 104, 204. According to one aspect the spring 104, 204 is winded around the axle 105, 205. According to an aspect the axle 105, 205 is connected to the drive unit 102, 202 and extends downwards from the drive unit 102, 202. According to an aspect the axle 105, 205 is positioned on one side of the drive unit 102, 202. According to an aspect the axle 105, 205 is positioned on one side of the motor 103, 203 and the spring 104, 204.

The spring 104, 204 are moved/compressed by the motor 103, 203 when it is moving the door leaf 400 in one direction and the motor 103, 203 and the spring 104, 204 together moves the door leaf 400 in the opposite direction. In this way the spring 104, 204 always have stored energy to move the door leaf 400 back to a starting position. This position could be either the open position or the closed position.

The axle 105, 205 is in one end connected to the drive unit 102, 202. The axle 105, 205 is connected to both the motor 103, 203 and the spring 104, 204. The axle 105, 205 is in the other end connected to the arm system 106, 206. When the axle 105, 205 is rotated by the drive unit 102, 202 it also rotates and moves the arm system 106, 206. According to an aspect the swing door operator is mounted to the wall such that the axle 105, 205 is positioned as close as possible to the door leaf 400.

According to an aspect the swing door operator 1 is arranged to close the door leaf 400 in case of an emergency. In such an arrangement the springs 104, 204 of the first and the second swing door operators 100, 200 are tensioned and arranged to store energy when the door leaf 400 is moved from the closed position to the open position by the motors 103, 203 of the first and/or the second swing door operator 100, 200. In this way the springs 104, 204 always have the energy to move the door leaf 400 from the open position to the closed position, even if the power to the motor 103, 203 is cut.

According to an aspect the swing door operators 100, 200 are arranged to open the door leaf 400 in case of an emergency. In such an arrangement the springs 104, 204 are tensioned and arranged to store energy when the door leaf 400 is moved from the open position to the closed position by the motors 103, 203 of the first and/or second swing door operators 100, 200. In this way the springs 104, 204 always have the energy to move the door leaf 400 from the closed position to the open position, even if the power to the motors 103, 203 is cut.

The control unit 101, 201 of the first and/or the second swing door operator 100, 200 controls when the drive units 102, 202 should move the door leaf 400 between the open and closed position and how it should move it. The speed pattern/trajectory that the control unit 101, 201 controls the drive units 102, 202 to move the door leaf 400 along comprise information of one or more of which speed the door leaf 400 should be moved, acceleration, braking, the opening time, for how long the door should be open and/or the closing speed etc. The control unit 101, 201 is arranged to store different speed trajectories and control the drive unit 102, 202 to move the door leaf 400 along different trajectories.

According to an aspect the drive unit 102, 202 is arranged to apply different trajectories based on how the swing door operators 100, 200 is mounted in relation to the door leaf 400. The control unit 101, 201 is according to some aspects connected to different sensors and systems and arranged to control the drive units 102, 202 based on received information from the sensors and systems. According to an aspect the control unit 101, 201 is connected to an alarm system. According to an aspect the control unit 101, 201 is connected to a fire alarm system.

The first swing door operator 100 is according to an aspect a pull swing door operator 100. The first swing door operator 100 is according to an aspect connected to a first side 401 of the door leaf 400 and mounted on a first side 301 of the wall 300. The arm system 106 of the pull swing door operator 100 is according to an aspect a pull arm system 106, as disclosed in FIG. 3*a-c*. The arm system 106 is in one end connected to the axle 105. The arm system 106 is in its other end connected to the door leaf 400. The pull arm system 106 comprises an arm 108 and an arm guide 109. The arm 8 is in one end connected to the axle 105. The arm 108 is in the other end slide ably connected to the arm guide 109. The arm guide 109 is mounted to the first side 401 of the door leaf 400. When the axle 105 is rotated, the arm 108 rotates together with the axle 105. As the arm 108 rotates, it pulls on the arm guide 109 and moves the arm guide 109 and at the same time the arm 108 slides in the arm guide 109. The arm guide 109 is mounted on the first side 401 of the door leaf 400 and as the arm 108 moves the arm guide 109 the first swing door operator 100 exert a force on the door leaf 400. When the axle 105 is rotated in the opposite direction, it will move the guide arm 109 and the door leaf 400 in the opposite direction. In this manner, the pull arm system 106 moves the door leaf 400 from the closed position to the open position and from the open position to the closed position. The length of the arm 108 and arm guide 109 and the position of the arm guide 109 on the door leaf 400 are set in relation to the position of the swing door operator 100 in relation to the door leaf 400 and the geometry of the door leaf 400.

The second swing door operator 200 is according to an aspect a push swing door operator 200. The second swing door operator 200 is according to an aspect connected to a second side 402 of the door leaf 400 and mounted on a second side 302 of the wall 300. The arm system 206 of the push swing door operator 200 is according to an aspect a push arm system 206, as disclosed in FIG. 3*a-c*. The arm system 206 is in one end connected to the axle 205. The arm system 206 is in its other end connected to the second side 402 of the door leaf 400. The second side 402 is opposite to the first side 401 of the door leaf 400. Put in another way, the first and second side 401, 402 is different sides of the door leaf 400. The pull arm system 206 comprises a first arm 208 and a second arm 209. The first arm 208 is in one end connected to the axle 205. When the axle 205 is rotated, the first arm 208 rotates together with the axle 205. The first arm 208 is in the other end rotatable connected to an end of the second arm 209. The second arm 209 is in the other end rotatable connected to the door leaf 400.

When the axle 205 is rotated by the drive unit 202, the first arm 208 rotates together with the axle 205. As the first arm 208 is rotated it pushes the second arm 209 to move. When the second arm 209 is moved by the first arm 208, it exert a force on the door leaf 400 and pushes on the door leaf 400. When moved, the second arm 209 is rotated in relation to the first arm 208 and the door leaf 400. When the axle 205 is rotated in the opposite direction by the drive unit 202 it will move the first arm 208, the second arm 209 and the door leaf 400 in the opposite direction. In this manner, the push door operator system 200 moves the door leaf 400 from the closed position to the open position and from the open position to the closed position. The length of the first arm 208 and the second arm 209 and the position of where the second arm 209 is connected to the second side 402 of the door leaf 400 are set in relation to the position of the push swing door operator 200 in relation to the door leaf 400 and the geometry of the door leaf 400.

There are a number of geometries and features that has to be taken into account when the arm systems 106, 206 should be configured. One or more of the following aspects is taken into account, the distance from the axle 105, 205 to the door leaf 400, the angle to which the door leaf 400 should be opened, the geometry of the door leaf 400, if the spring 104, 204 should open or close the door leaf 400.

The pull swing door operator 100 and the push swing door operator 200 have different strengths and advantages and the control unit 101, 201 can regulate them such that the swing door operator system 1 utilizes these in the best way in different positions when moving the door leaf 400 between the opened and closed position. The swing door operator system 1 comprising the pull swing door operator 100 and the push swing door operator 200 according to an aspect have a more advanced speed trajectory that it moves the door leaf 400 along in comparison to if the door leaf 400 is moved by only a single door operator.

The push swing door operator 200 has the advantage that it has a higher gearing (compared to a pull swing door operator) when the door leaf 400 is in the closed position. This is favourable when the at least one door leaf 400 is in the closed position to overcome frictions between the door leaf 400 and the door frame 300 and to overcome pressure differences at different sides of the door. The pull swing door operator 100 according to an aspect comprise a door stop that assist to hold the door leaf 400 in the open position. The swing door operator system 1 according to the invention thus have both these favourable features as it both have the push swing door operator 200 and the pull swing door operator 100.

The swing door operator system 1 comprising the first and the second swing door operators 100, 200 according to an aspect move the door leaf 400 with a weight that is the double compared to what the first or the second swing door operator 100, 200 can move if they were mounted as a single door operator.

According to an aspect the first and the second swing door operators 100, 200 are similar models/size/strengths but with different arm systems 106, 206, i.e. the first and second swing door operators are the same and one of them comprise a pull arm system 106 and the other comprise a push arm system 206.

According to an aspect the first and the second swing door operators 100, 200 are different types of swing door operators.

Figure 3A:
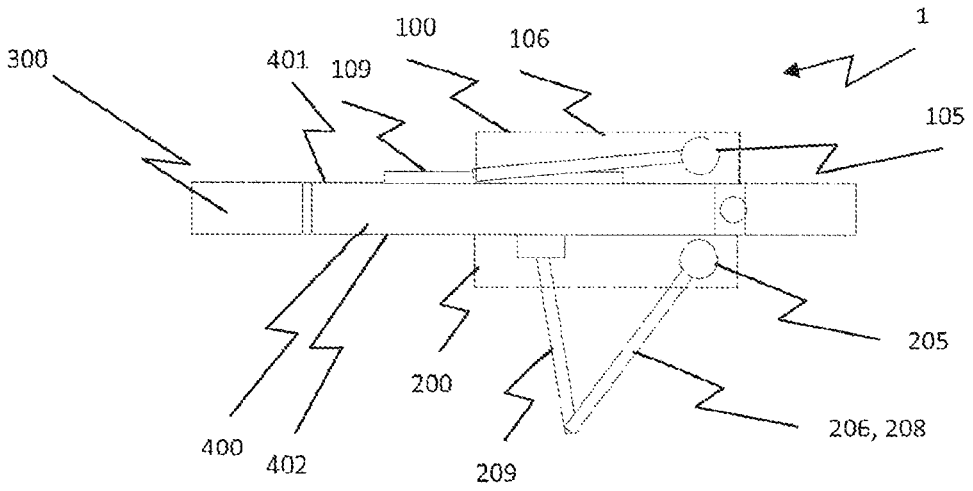
FIG. 3*a* shows a schematic cross sectional view from above of a swing door operator system with the door in a closed position.

The swing door operator system 1 according to an aspect is disclosed in FIG. 3*a* in which the door leaf 400 is in its closed position. The first swing door operator 100 is mounted at the wall 300 on the first side 301 and connected to the first side 401 of the door leaf 400. The second swing door operator 200 is mounted at the wall 300 on the second side 302 and connected to the second side 401 of the door leaf 400.

The swing door operator system 1 comprising at least the first swing door operator 100, the second swing door operator 200, the wall 300, and at least one door leaf 400. According to an aspect the at least one door leaf 400 is hinged connected at the opening 304 in the wall 300. According to an aspect the first swing door operator 100 is connected to the first side 401 of the door leaf 400. According to an aspect the second swing door operator 200 is connected to the second side 402 of the door leaf 400. According to an aspect the first side 401 of the door leaf 400 is opposite to the second side 402 of the door leaf 400. According to an aspect the first swing door operator 100 and the second swing door operator 200 are configured to interact to move the door leaf 400 between an open and closed position.

According to an aspect the control unit 101 of the first swing door operator 100 is connected to the second swing door operator 200 and the control unit 101 is configured to regulate the operation of both the first and the second swing door operator 100, 200.

According to an aspect the control unit 201 of the second swing door operator 200 is connected to the first swing door operator 100 and the control unit 201 is configured to regulate the operation of both the first and the second swing door operator 100, 200.

According to an aspect the control unit 101 of the first swing door operator 100 is connected to the drive units 102, 202 of the first and the second swing door operator 100, 200 and arranged to control the operation of the drive units 102, 202. According to an aspect the control unit 201 of the second swing door operator 200 is connected to the drive units 102, 202 of the first and the second swing door operator 100, 200 and arranged to control the operation of the drive units 102, 202. According to an aspect the control unit 101 of the first swing door operator 100 is a master control unit 101 configured to regulate both the first and the second swing door operator 100, 200. According to an aspect the control unit 201 of the second swing door operator 200 is a master control unit 201 configured to regulate both the first and the second swing door operator 100, 200. According to an aspect the one of the first and the second swing door operator 100, 200 is configured to be a master swing door operator 100, 200 and the other of the first and the second swing door operator 100, 200 is configured to be a slave swing door operator 100, 200.

According to an aspect the first swing door operator 100 is a pull swing door operator 100 and the second swing door operator 200 is a push swing door operator 200. According to an aspect the pull swing door operator 100 is configured to pull the door leaf 400 when moving it towards the open position and to push the door leaf 400 when moving it towards the closed position. According to an aspect the push swing door operator 200 is configured to push the door leaf 400 when moving it towards the open position and to pull the door leaf 400 when moving it towards the closed position.

According to an aspect the control unit 101, 201 is configured to regulate the first and second swing door operators 100, 200 to move the door leaf 400 with a predefined speed pattern from its closed position to its open position and from its open position to its closed position by regulating the force exerted from the first swing door operator 100 and the second swing door operator 200 to exert a combined force according to a predefined force pattern.

According to an aspect the predefined force pattern comprise information regarding the amount of force between 0-100% of its capacity exerted from the first swing door operator 100 at different positions of the door leaf 400 and information regarding the amount of force between 0-100% of its capacity exerted from the second swing door operator 200 at different positions of the door leaf 400. According to an aspect the control unit 101, 201 of the first and/or second swing door operator is configured to regulate the first drive unit 102 to exert 100% of its capacity and the second drive unit 202 to exert 100% of its capacity when moving the door leaf 400 between the open and closed position.

According to an aspect the control unit 101, 201 of the first and/or second swing door operator 100, 200 is configured to regulate the first drive unit 102 to exert between 0-100% of its capacity and the second drive unit 202 to exert 0-100% of its capacity when moving the door leaf 400 between the open and closed position.

According to an aspect the control unit 101, 201 of the first and/or second swing door operator 100, 200 is configured to regulate the first drive unit 102 to exert a varying force between 0-100% of its capacity and the second drive unit 202 to exert a varying force between 0-100% of its capacity when moving the door leaf 400 between the open and closed position.

According to an aspect the first swing door operator 100 is mounted at the first side 301 of the wall 300, the second swing door operator 200 is mounted at the second side 302 of the wall 300, and the first side 301 of the wall 301 is opposite to the second side 302 of the wall 300.

Hereafter a cycle of the swing door operator system 1 for moving the door leaf 400 from the closed position to the open position and thereafter from the open position to the closed position will be described with reference to FIG. 3*a* c.

In this example the control unit 101 of the first swing door operator 100 is the master control unit 101 and the control unit 201 of the second swing door operator 200 is not used.

The control unit 101 receives input of that the swing door operator system 1 should open the door leaf 400. The input could be from a sensor or a button and the creation of such input as such is known and will not be described in more detail herein.

The control unit 1 regulate the drive unit 102 of the first swing door operator 100 and the drive unit 202 of the second swing door operator 200 to cooperate and move the door leaf 400 from its closed position towards the open position. The control unit 101 regulates the first and the second drive unit 102, 202 to move the door leaf 400 by regulating the force or torque that the motor 103, 203 of the first and the second swing door operator 100, 200 exert on the door leaf 400 via their axle 105, 205 and their arm system 106, 206. The control unit 101 according to an aspect regulates the force exerted by the first swing door operator 100 to be different from the force exerted from the second swing door operator 200 at different positions between the open and closed position. By regulating the force exerted from the first and the second swing door operators 100, 200 to be different, the speed trajectory that the door leaf 400 is moved with between the open and closed position could be optimized. The combination of a pull swing door operator 100 and a push swing door operator 200 brings that the pull swing door operator 100 could exert a higher force at positions of the door leaf 400 where it is stronger and more efficient and exert a lower force at positions of the door leaf 400 where it is not that efficient and the push swing door operator 200 could exert a higher force at positions of the door leaf 400 where it is stronger and more efficient and exert a lower force at positions of the door leaf 400 where it is not that efficient. The combination of a first and second swing door operator 100, 200 makes it possible for the swing door operator system 1 to move door leafs 400 that would be to heavy or large for a single door operator to move. It also makes it possible to move the door leaf 400 with different speed patterns/trajectories that would not be possible to achieve with a single door operator.

Figure 3B:
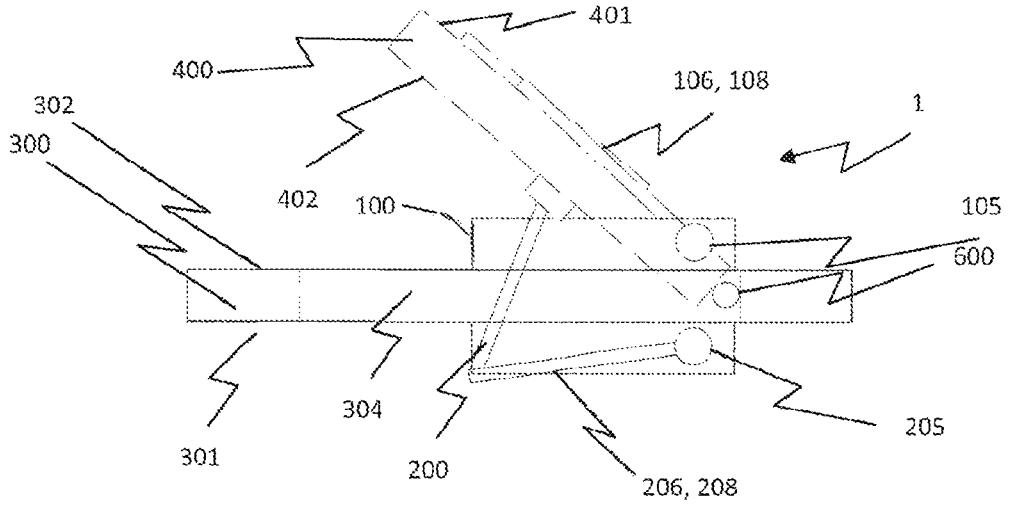
FIG. 3*b* shows a schematic cross sectional view from above of a swing door operator system with the door in an intermediate position between the open and closed position.
Figure 3C:
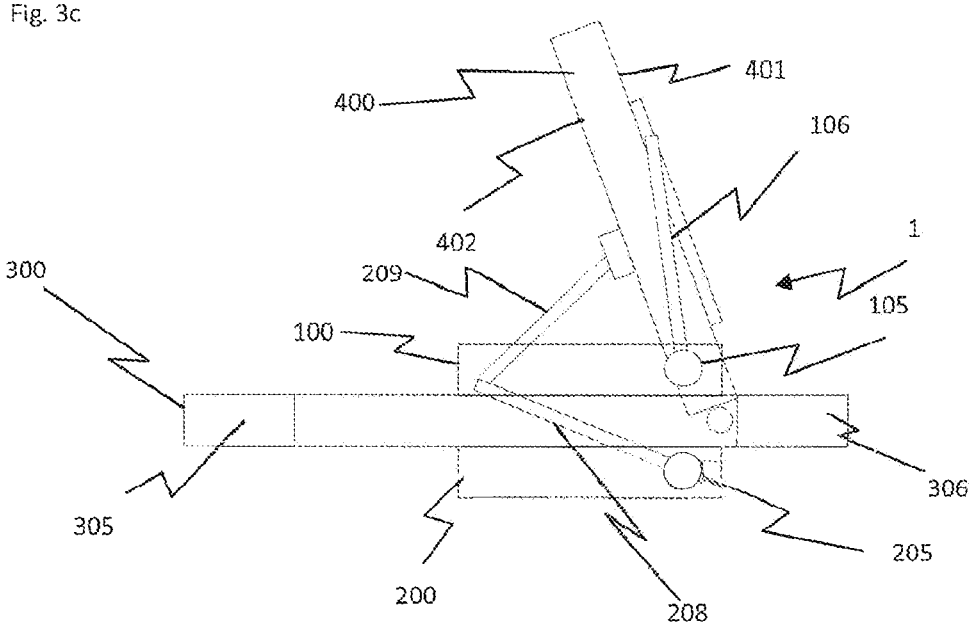
FIG. 3*c* shows a schematic cross sectional view from above of a swing door operator system with the door in an open position.

The control unit 101 regulates the first and the second swing door operator 100, 200 to move the door leaf 400 in cooperate towards the open position, as disclosed in FIG. 3*b*, and forward to the opened position, as disclosed in FIG. 3*c*.

Thereafter the control unit 101 regulates the first and the second swing door operator 100, 200 to hold the door leaf 400 in the open position for a predefined period of time or until it receives input of that the door leaf 400 should be closed.

The control unit 101 receives input of that the door leaf 400 should be closed and regulates the first and the second swing door operator 100, 200 to move the door leaf 400 in cooperate towards the open position.

According to an aspect, the control unit 101 of the first swing door operator 100 cooperates with the control unit 201 of the second swing door operator 200 to regulate the first and second swing door operator 100, 200 to move the door leaf 400 between the opened and closed position.

The wall 300, as disclosed in FIGS. 2 and 3*a-c*, comprise a first wall section 305 at one side of the doorframe 500 and a second wall section 306 at the other side of the doorframe 300. The wall comprises an opening 304 in which the doorframe 500 is mounted. The first and second wall section 305, 306 is positioned on opposite sides of the doorframe 500 and the wall opening 304. Put in another way, the first and the second wall sections 305, 306 are positioned at a lateral side of the doorframe 500 and the door opening 304. The first and/or second wall section 305, 306 could according to an aspect be located in direct contact with the doorframe 500. According to an aspect the first and/or second wall sections 305, 306 are located at a distance from the doorframe 500.

According to an aspect the wall 300 further comprises a third wall section 307 positioned above the doorframe 300.

By wall is meant any type of structure that surrounds the doorframe 300 and that the doorframe is connected to.

According to an aspect the door frame 500 comprise two vertical elements 501, 502 and a horizontal element 503 connecting the two vertical elements 501, 502. According to an aspect the door leaf 400 is hinged connected by the hinge 600 to one of the vertical elements 501, 502, as disclosed in FIG. 3*a-c*. According to an aspect the door leaf 400 is hinged connected by the hinge 600 to one of the first or second wall sections 305, 306, as disclosed in FIG. 3*a-c*.

According to an aspect one door leaf 400 is hinged connected to one of the vertical elements 301, 302 and the second door leaf 400 is hinged connected the other vertical element 302, 301.

The door leaf 400 as such is known in the art and will thus not be described in detail herein.

In order to provide safe door leaf movement, one or several sensors or IR-curtains may be used in order to detect any obstacles located in the path of the door leaf. For a swing door set, the door operator is preferably connected to safety sensors arranged on the opening/closing edge of the door leaf.

The open position of the door lead 400 is according to an aspect that the door leaf 400 is opened to an angle $\alpha$ of approximately 80-110° in relation to the surrounding walls, which is a common door-opening angle during regular use. The closed position is according to an aspect that the door leaf is arranged at a 0° angle, i.e. the door opening is completely closed by the door leaf.

The person skilled in the art realizes that the present invention by no means is limited to the preferred embodiments described above. On the contrary, many modifications and variations are possible within the scope of the appended claims.

The invention claimed is:

1. A swing door operator system comprising at least a first swing door operator, a second swing door operator, and at least one door leaf comprising a first major surface and a second major surface away from and opposite to the first major surface, the at least one door leaf hinged connected at an opening in a wall, wherein the first swing door operator is connected to the first major surface of the at least one door leaf, the second swing door operator is connected to the second major surface of the at least one door leaf, and the first swing door operator and the second swing door operator are configured to interact to move the at least one door leaf between an open and closed position.

2. The swing door operator system according to claim 1, wherein at least one of the first and the second swing door operator comprises a control unit connected to another of the first or second swing door operator, and wherein the control unit is configured to regulate the operation of the first and the second swing door operator.

3. The swing door operator system according to claim 2, wherein the control unit is configured to regulate the first and second swing door operators to move the at least one door leaf with a predefined speed pattern from the closed position to the open position and from the open position to the closed position by regulating the force exerted from the first swing door operator and the second swing door operator to exert a combined force according to a predefined force pattern.

4. The swing door operator system according to claim 3, wherein the predefined force pattern comprises information regarding the amount of force between 0-100% of capacity exerted from the first swing door operator at different positions of the at least one door leaf and information regarding the amount of force between 0-100% of the capacity exerted from the second swing door operator at different positions of the at least one door leaf.

5. The swing door operator system according to claim 1, wherein the first and the second swing door operators comprise a drive unit comprising at least one motor and at least one spring, wherein the motor and the spring is arranged to interact to move the at least one door leaf.

6. The swing door operator system according to claim 5, wherein the control unit is connected to the drive unit and arranged to control the operation of the drive unit.

7. The swing door operator system according to claim 5, wherein at least one of the first and the second swing door operators comprises an axle and an arm system, the axle is connected to the drive unit and to the arm system, and the arm system is further connected to the first or second surface of the at least one door leaf, wherein the axle and the arm system is arranged to interact with the drive unit to move the at least one door leaf.

8. The swing door operator system according to claim 7, wherein the arm system of the first swing door operator is a pull arm system arranged to pull the at least one door leaf from the closed position to the open position.

9. The swing door operator system according to claim 7, wherein the arm system of the second swing door operator is a push arm system arranged to push the at least one door leaf from the closed position to the open position.

10. The swing door operator system according to claim 1, wherein the first swing door operator is a pull swing door operator and the second swing door operator is a push swing door operator.

11. The swing door operator system according to claim 10, wherein the pull swing door operator is configured to pull the at least one door leaf to move the at least one door leaf towards the open position, and to push the at least one door leaf to move the at least one door leaf towards the closed position.

12. The swing door operator system according to claim 10, wherein the push swing door operator is configured to push the at least one door leaf to move the at least one door leaf towards the open position, and to pull the at least one door leaf to move the at least one door leaf towards the closed position.

13. The swing door operator system according to claim 1, comprising a door frame mounted in the opening in the wall and comprising two vertical elements and a horizontal element connecting the two vertical elements, and the at least one door leaf is hinged connected to one of the vertical elements.

14. The swing door operator system according to claim 1, wherein the first swing door operator is mounted at a first side of the wall, the second swing door operator is mounted at a second side of the wall, and the first side of the wall is opposite to the second side of the wall.

15. The swing door operator system according to claim 1, wherein the at least one door leaf swings about a single axis of rotation.

16. The swing door operator system according to claim 15, wherein the axis of rotation is positioned at the wall and parallel to the wall.

* * * * *